US011100854B2

(12) United States Patent
Wang

(10) Patent No.: US 11,100,854 B2
(45) Date of Patent: Aug. 24, 2021

(54) DRIVING METHOD FOR DISPLAY SUBSTRATE, DRIVING CIRCUIT AND DISPLAY DEVICE

(71) Applicants: CHENGDU BOE OPTOELECTRONICS TECHNOLOGY CO., LTD., Sichuan (CN); BOE TECHNOLOGY GROUP CO., LTD., Beijing (CN)

(72) Inventor: Tiegang Wang, Beijing (CN)

(73) Assignees: CHENGDUE BOE OPTOELECTRONICS TECHNOLOGY CO., LTD., Sichuan (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/642,258

(22) PCT Filed: Aug. 22, 2019

(86) PCT No.: PCT/CN2019/101963
§ 371 (c)(1),
(2) Date: Feb. 26, 2020

(87) PCT Pub. No.: WO2020/038432
PCT Pub. Date: Feb. 27, 2020

(65) Prior Publication Data

US 2021/0043136 A1 Feb. 11, 2021

(30) Foreign Application Priority Data

Aug. 22, 2018 (CN) ..... 201810961274.5

(51) Int. Cl.
*G09G 3/3225* (2016.01)
*G09G 3/20* (2006.01)

(52) U.S. Cl.
CPC ..... *G09G 3/3225* (2013.01); *G09G 3/2007* (2013.01); *G09G 2310/0232* (2013.01);
(Continued)

(58) Field of Classification Search
CPC ..... G09G 3/3225; G09G 3/2007; G09G 2310/0232; G09G 2320/0209;
(Continued)

(56) References Cited

U.S. PATENT DOCUMENTS

2018/0158417 A1* 6/2018 Xiang ..... G09G 3/3233
2019/0073961 A1* 3/2019 Park ..... G02F 1/1362
(Continued)

*Primary Examiner* — Richard J Hong
(74) *Attorney, Agent, or Firm* — Muncy, Geissler, Olds and Lowe, P.C.

(57) ABSTRACT

A driving method for a display substrate, a driving circuit and a display device are provided. In the driving method of the display substrate, the display substrate includes an active display region and a notch region embedded in the active display region, a pixel array is arranged at the active display region and the notch region, and a gate line and a data line at the active display region extend to the notch region. The notch region includes a first region and a second region other than the first region, a first side of the first region is not adjacent to the active display region. The driving method includes, when an image is displayed by the display substrate, inputting grayscale data having a grayscale value smaller than $2^n-1$ and greater than 0 to pixels at at least a part of the first region. The grayscale data is n-bit data.

18 Claims, 2 Drawing Sheets

(52) U.S. Cl.
CPC ..... *G09G 2320/0209* (2013.01); *G09G 2320/0233* (2013.01)

(58) Field of Classification Search
CPC ..... G09G 2320/0233; G09G 3/20; G09G 3/3275; G09G 3/3233; G09G 3/3648; H01L 27/3272; H01L 27/32; G02F 1/1362; G02F 1/136286
See application file for complete search history.

(56) References Cited

U.S. PATENT DOCUMENTS

| | | | | |
|---|---|---|---|---|
| 2019/0073962 | A1* | 3/2019 | Aflatooni | G09G 3/3275 |
| 2019/0156739 | A1* | 5/2019 | Hwang | G09G 3/20 |
| 2019/0180694 | A1* | 6/2019 | Lim | H01L 27/3272 |
| 2019/0197976 | A1* | 6/2019 | Sasaki | G09G 3/3648 |
| 2020/0058242 | A1* | 2/2020 | Liu | H01L 27/32 |
| 2020/0402460 | A1* | 12/2020 | Ka | G02F 1/136286 |

* cited by examiner

DRIVING METHOD FOR DISPLAY SUBSTRATE, DRIVING CIRCUIT AND DISPLAY DEVICE

CROSS-REFERENCE TO RELATED APPLICATIONS

The present application is the U.S. national phase of PCT Application No. PCT/CN2019/101963 filed on Aug. 22, 2019, which claims a priority of the Chinese patent application No. 201810961274.5 filed in China on Aug. 22, 2018, the disclosures of which are incorporated herein by reference in their entireties.

TECHNICAL FIELD

The present disclosure relates to the field of display technology, in particular to a driving method for a display substrate, a driving circuit, and a display device.

BACKGROUND

Currently, for an Active Matrix Organic Light-Emitting Diode (AMOLED) display panel with a notch region, data about the notch region is subjected to black insertion. When a white image is refreshed on the display panel, data about black is inputted to pixels at the notch region, and data about white is inputted to pixels at a region other than the notch region, so there is a relatively large voltage difference between a data signal on a data line connected to a row of pixels nearest to the notch region and a data signal on a data line connected to a previous row of pixels. A voltage jump leads to a jump of an ELVDD in the AMOLED display panel due to the coupling, so a brightness change may occur, and thereby a crosstalk between lines may occur visually.

SUMMARY

An object of the present disclosure is to provide a driving method for a display substrate, a driving circuit, and a display device, so as to solve the above-mentioned problem.

In one aspect, the present disclosure provides in some embodiments a driving method for a display substrate. The display substrate includes an active display region and a notch region engaged with the active display region, a pixel array is arranged at the active display region and the notch region, and a gate line and a data line at the active display region extend to the notch region. The notch region includes a first region and a second region other than the first region, a first side of the first region is not adjacent to the active display region, and a second side of the first region is adjacent to the active display region. The driving method includes, when an image is displayed by the display substrate, inputting grayscale data having a grayscale value smaller than $2^n-1$ and greater than 0 to pixels at at least a part of the first region. The grayscale data is n-bit data.

Further, the second side of the first region is adjacent to a first boundary of the active display region, and the second side of the first region and the first boundary of the active display region are each a straight line extending in a row direction of the pixel array. The inputting the grayscale data having the grayscale value smaller than $2^n-1$ and greater than 0 to the pixels at at least a part of the first region includes: inputting white grayscale data having a grayscale value smaller than $2^n-1$ and greater than 0 to the pixels at at least a part of the first region; and inputting black grayscale data to pixels at the second region.

Further, the inputting the white grayscale data to the pixels at at least a part of the first region includes: inputting green grayscale data having a grayscale value smaller than $2^n-1$ and greater than 0 to pixels at a boundary region of the first region adjacent to the first boundary; and inputting the white grayscale data to pixels at the first region other than the boundary region.

Further, the pixels at the boundary region include a row of pixels nearest to the first boundary among rows of pixels in the pixel array.

Further, the second region includes a third region and a fourth region, the first region is a rectangular region arranged between the third region and the fourth region, the first side of the first region is adjacent to a first side of the third region, a second side of the third region is adjacent to the active display region, a third side of the first region is adjacent to a first side of the fourth region, a second side of the fourth region is adjacent to the active display region, and the first side and the third side of the first region are arranged opposite to each other and extend in a column direction of the pixel array.

Further, the grayscale value of the white grayscale data is $2^n/2-1$ or $2^n/2$.

Further, the grayscale value of the green grayscale data is $2^n/2-1$ or $2^n/2$.

Further, the display substrate is an OLED display substrate.

In another aspect, the present disclosure provides in some embodiments a driving circuit for a display substrate. The display substrate includes an active display region and a notch region engaged with the active display region, a pixel array is arranged at the active display region and the notch region, and a gate line and a data line at the active display region extend to the notch region. The notch region includes a first region and a second region other than the first region, a first side of the first region is not adjacent to the active display region, and a second side of the first region is adjacent to the active display region. The driving circuit is configured to, when an image is displayed by the display substrate, input grayscale data having a grayscale value smaller than $2^n-1$ and greater than 0 to pixels at at least a part of the first region. The grayscale data is n-bit data.

Further, the second side of the first region is adjacent to a first boundary of the active display region, and the second side of the first region and the first boundary of the active display region are each a straight line extending in a row direction of the pixel array. The driving circuit is further configured to input white grayscale data having a grayscale value smaller than $2^n-1$ and greater than 0 to the pixels at at least a part of the first region, and input black grayscale data to pixels at the second region.

Further, the driving circuit is further configured to input green grayscale data having a grayscale value smaller than $2^n-1$ and greater than 0 to pixels at a boundary region of the first region adjacent to the first boundary, and input the white grayscale data to pixels at the first region other than the boundary region.

Further, the pixels at the boundary region include a row of pixels nearest to the first boundary among rows of pixels in the pixel array.

Further, the second region includes a third region and a fourth region, the first region is a rectangular region arranged between the third region and the fourth region, the first side of the first region is adjacent to a first side of the third region, a second side of the third region is adjacent to the active display region, a third side of the first region is adjacent to a first side of the fourth region, a second side of the fourth region is adjacent to the active display region, and the first side and the third side of the first region are arranged opposite to each other and extend in a column direction of the pixel array.

Further, the grayscale value of the white grayscale data is $2^n/2-1$ or $2^n/2$.

Further, the grayscale value of the green grayscale data is $2^n/2-1$ or $2^n/2$.

In yet another aspect, the present disclosure provides in some embodiments a display device including the above-mentioned driving circuit.

BRIEF DESCRIPTION OF THE DRAWINGS

In order to illustrate the technical solutions of the present disclosure in a clearer manner, the drawings desired for the present disclosure will be described hereinafter briefly. Obviously, the following drawings merely relate to some embodiments of the present disclosure, and based on these drawings, a person skilled in the art may obtain other drawings without any creative effort.

DETAILED DESCRIPTION

In order to make the technical problems, the technical solutions and the advantages of the present disclosure more apparent, the present disclosure will be described hereinafter in a clear and complete manner in conjunction with the drawings and embodiments.

Figure 1:
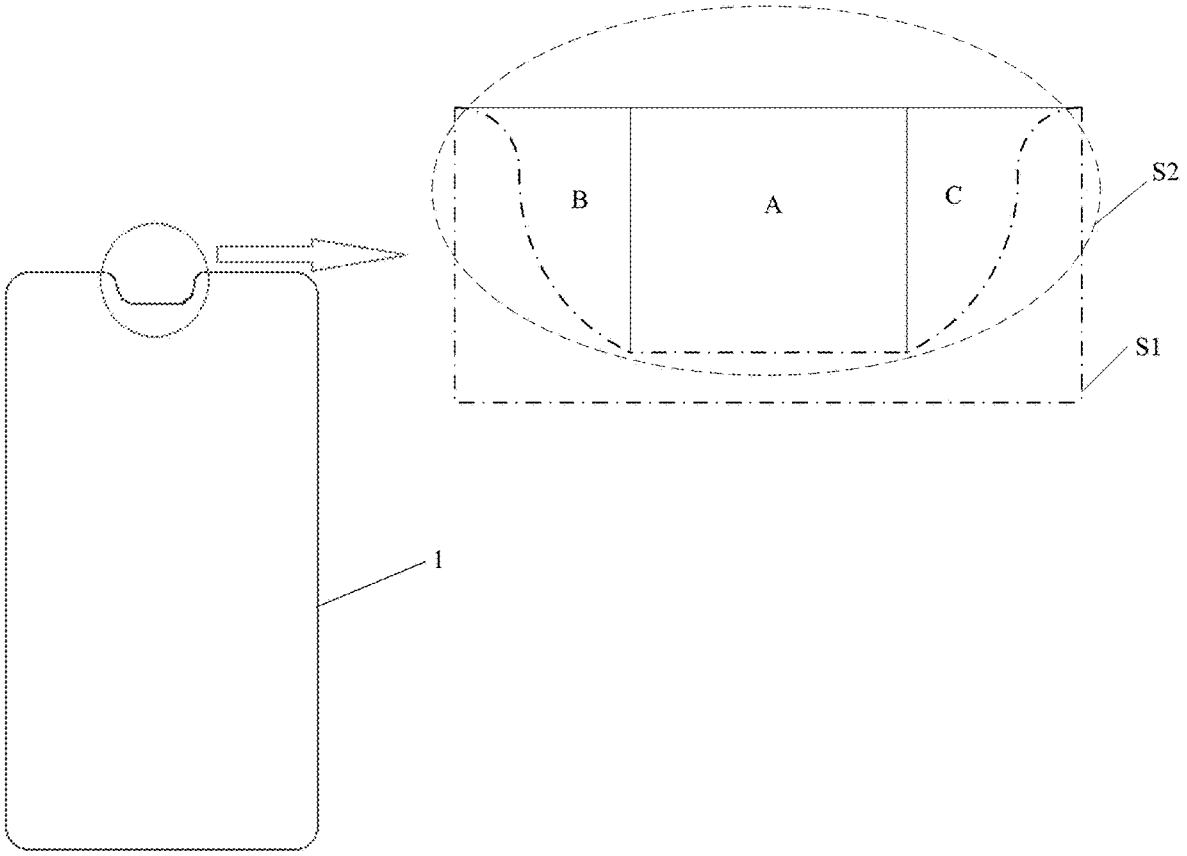
FIG. 1 is a schematic view showing different display regions of a notch region according to an embodiment of the present disclosure.

Currently, a trend of mobile terminals, e.g., mobile phones, is to provide a full screen, i.e., provide a larger screen-to-body ratio. However, for the arrangement of a front camera, an opening for a telephone receiver, an opening for an infrared (IR) beam and the like at a front face of the mobile phone, a screen of the mobile phone is provided with a notch region S2. As shown in FIG. 1, the notch region S2 is embedded into an active display region S1, and the notch region S2 is not used for display. A right part in FIG. 1 is an enlarged view of a portion of a circle in a left part in FIG. 1. In FIG. 1, the notch region S2 is of an irregular shape.

In the related art, data for the notch region S2 is subjected to black insertion, i.e., data about black is inputted to pixels at the entire notch region, and then transition treatment is performed on pixels adjacent to black pixels (when no transition treatment is performed, obvious sawteeth may occur at a boundary of the notch region S2). In this regard, when the data about black is inputted to the entire notch region S2 and the transition treatment (for a gradual change from black to white) is performed on the pixels adjacent to the notch region, a smooth brightness change without any sawteeth may occur visually. However, when the data about black is inputted to the entire notch region S2 and a white image is refreshed on a display panel, since the data about white is inputted to pixels at a region other than the notch region S2 and the data about black is inputted to the notch region S2, there is a relatively large voltage difference between a data signal on a data line connected to a row of pixels nearest to the notch region S2 and a data signal on a data line connected to a previous row of pixels. A voltage jump leads to a jump of an ELVDD in the Organic Light Emitting Diode (OLED) display panel due to the coupling, so the brightness change may occur, and thereby a crosstalk between lines may occur visually.

In view of the above problems, an object of the present disclosure is to provide a driving method for a display substrate, a driving circuit and a display device, so as to improve a display effect of the OLED display device.

Figure 2:
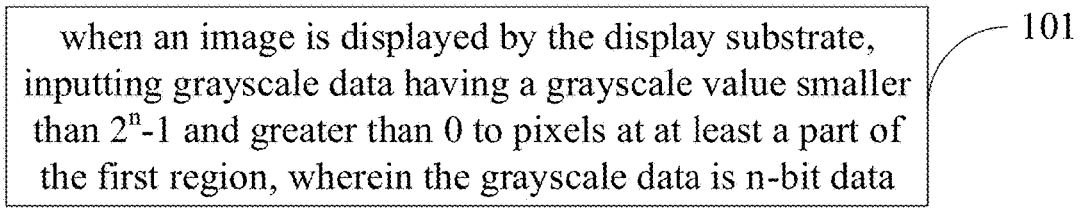
FIG. 2 is a flow chart of a driving method for a display substrate according to an embodiment of the present disclosure.
Figure 3:
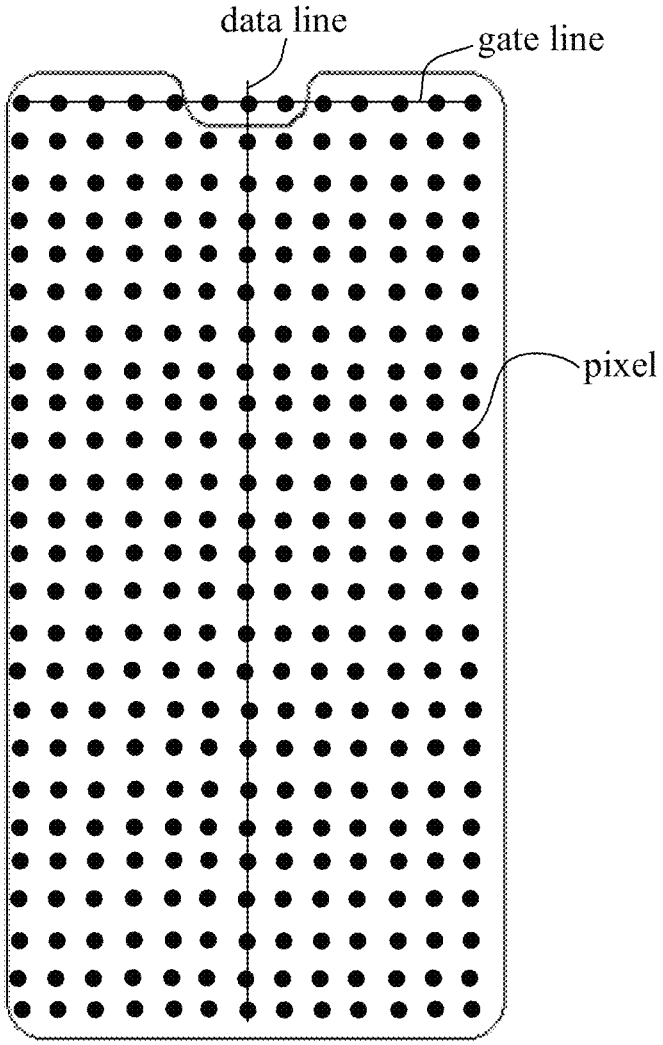
FIG. 3 is a schematic view showing a pixel array on the display substrate according to an embodiment of the present disclosure.

The present disclosure provides in some embodiments a driving method for a display substrate. As shown in FIG. 1, the display substrate 1 includes an active display region S1 and a notch region S2 embedded in the active display region. The notch region S1 includes a first region A and a second region other than the first region, i.e., the second region includes a third region B and a fourth region C. A first side (a left side) of the first region A is not adjacent to the active display region S1, and a second side (a bottom side) of the first region A is adjacent to the active display region S1. As shown in FIG. 3, a gate line and a data line at the active display region extend to the notch region, and a pixel array is arranged at the active display region S1 and the notch region S2. A person skilled in the art understands that, FIG. 3 merely shows relative position relationship among pixels, the data line and the gate line, but shall not be used to define an actual connection relationship thereamong. In addition, although there may be actually many data lines and gate lines on a display panel, FIG. 3 merely illustratively shows one data line and one gate line. As shown in FIG. 2, the driving method includes Step 101 of, when an image is displayed by the display substrate, inputting grayscale data having a grayscale value smaller than $2^n-1$ and greater than 0 to pixels at at least a part of the first region, wherein the grayscale data is n-bit data, and n may be an integer greater than or equal to 2.

According to the embodiments of the present disclosure, when the image is displayed by the display substrate, the grayscale data having the grayscale value smaller than $2^n-1$ and greater than 0 may be inputted to the pixels at pixels at a region of the notch region adjacent to the active display region. Hence, when the image is displayed by the display substrate, the inputted grayscale value may be adjusted so as to provide a relatively small difference between the grayscale value of the grayscale data inputted to the pixels at the region of the notch region adjacent to the active display region and the grayscale value of the grayscale data inputted to the pixels at the active display region. As a result, it is able to reduce a voltage difference between a data signal on a data line connected to the pixels at a region of the active display region adjacent to the notch region and a data signal on a data line connected to the pixels at the notch region, and prevent the occurrence of a jump of an ELVDD, thereby to prevent the occurrence of a crosstalk between lines and improve a display effect of the display substrate.

In a possible embodiment of the present disclosure, the second side (the bottom side) of the first region A may be adjacent to a first side (an top side of a middle portion) of the active display region S1, and a first boundary between the second side (the bottom side) of the first region A and the first side (the top side of the middle portion) of the active display region S1 may be a straight line extending in a row direction of the pixel array. The driving method may specifically include: inputting white grayscale data having a grayscale value smaller than $2^n-1$ and greater than 0 to the pixels at at least a part of the first region; and inputting black grayscale data to pixels at the second region.

In the embodiments of the present disclosure, the white grayscale data may be inputted to the pixels at the first region of the notch region adjacent to the active display region, so as to provide a relatively small difference between the grayscale value of the grayscale data at the first region and the grayscale value of the grayscale data at the active display region. As a result, it is able to reduce a voltage difference between a data signal on a data line connected to the pixels at a region of the active display region adjacent to the notch region and a data signal on a data line connected to the pixels at the first region, and prevent the occurrence of a jump of the ELVDD, thereby to prevent the occurrence of the crosstalk between lines and improve the display effect of the display substrate. In addition, the black grayscale data may be inputted to the pixels at the second region, so as to subject a boundary of the notch region to smoothing treatment and reduce the occurrence of sawteeth in the displayed image.

Further, the inputting the white grayscale data to the pixels at at least a part of the first region may include: inputting green grayscale data having a grayscale value smaller than $2^n-1$ and greater than 0 to pixels at a boundary region of the first region adjacent to the first boundary; and inputting the white grayscale data to pixels at the first region other than the boundary region. The pixels at the boundary region may include a row of pixels nearest to the first boundary among all rows of the pixel array, i.e., pixels in a boundary row.

Usually, an AMOLED display substrate is provided with a Sub-Pixel Rendering (SPR) structure, and when one row of pixels are used for display, red subpixels and blue subpixels of pixels in a previous row may also participate in the display. When the white grayscale data is inputted to the pixels in the boundary row at the first region adjacent to the active display region, the red subpixels and the blue subpixels in the boundary row may also participate in the display. When the pixels in a row (at the active display region) next to the boundary row are used for display, the red subpixels and the blue subpixels in the boundary row may also participate in the display, so a color abnormality may occur for the pixels in the row next to the boundary row. When the green grayscale data is inputted to the pixels in the boundary row, the red subpixels and the blue subpixels in the boundary row may not participate in the display, so the display using the pixels in the row next to the boundary row may not be adversely affected. In addition, when the green grayscale data having the grayscale value smaller than $2^n-1$ and greater than 0 may be inputted to the pixels in the boundary row, and when an image is displayed by the display panel, the inputted grayscale value may be adjusted, so as to provide a relatively small difference between the grayscale value of the grayscale data inputted to the pixels in the boundary row and the grayscale value of the grayscale data inputted to the pixels in the next row. As a result, it is able to reduce the voltage difference between the data signal on the data line connected to the pixels in the boundary row and the data signal on the data line connected to the pixels in the next row, and prevent the occurrence of a jump of the ELVDD, thereby to prevent the occurrence of the crosstalk between lines and improve the display effect of the display substrate.

Other two sides (i.e., the first side (the left side) and a third side (a right side)) of the first region A crossing the second side (the bottom side) of the first region A may extend in a column direction of the pixel array. To be specific, as shown in FIG. 1, the first region A may be a rectangular region arranged between the third region B and the fourth region C. The first side (the left side) of the first region A may be adjacent to a first side (a right side) of the third region B, a second side (a left side) of the third region B may be adjacent to the active display region S1, a third side (a right side) of the third region A may be adjacent to a first side (a left side) of the fourth region C, a second side (a right side) of the fourth region C may be adjacent to the active display region S1, and the first side (the left side) and the third side (the right side) of the first region A may be arranged opposite to each other and extend in a column direction of the pixel array. It should be appreciated that, the other two sides (i.e., the first side (the left side) and the third side (the right side)) of the first region A crossing the second side (the bottom side) of the first region A may not be limited to extending in the column direction, and they may alternatively extend along another straight line or a curve.

In a possible embodiment of the present disclosure, the grayscale value of the white grayscale data may be $2^n/2-1$ or $2^n/2$. When the white grayscale data is 8-bit data, the grayscale value of the white grayscale data may be 127 or 128. In this regard, when a white image having a grayscale value of 255 is displayed by the display substrate, a difference between the grayscale value of the grayscale data at a region of the first region adjacent to the active display region and the grayscale value of the grayscale data at the active display region may be not greater than 128. At this time, it is able to reduce the voltage difference between the data signal on the data line connected to the pixels at a region of the active display region adjacent to the first region and the data signal on the data line connected to the pixels at the first region, and prevent the occurrence of a jump of the ELVDD, thereby to prevent the occurrence of the crosstalk between lines and improve the display effect of the display substrate. When a black image having a grayscale value of 0 is displayed by the display substrate, a difference between the grayscale value of the grayscale data at a region of the first region adjacent to the active display region and the grayscale value of the grayscale data at the active display region may be not greater than 128 too. At this time, it is able to reduce the voltage difference between the data signal on the data line connected to the pixels at a region of the active display region adjacent to the first region and the data signal on the data line connected to the pixels at the first region, and prevent the occurrence of a jump of the ELVDD, thereby to prevent the occurrence of the crosstalk between lines and improve the display effect of the display substrate. In a word, regardless of the color of the image displayed by the display substrate, the difference between the grayscale value of the grayscale data at a region of the first region adjacent to the active display region and the grayscale value of the grayscale data at the active display region may be not greater than 128. As a result, it is able to reduce the voltage difference between the data signal on the data line connected to the pixels at a region of the active display region adjacent to the notch region and the data signal on the data line connected to the pixels at the notch region, and prevent the occurrence of a jump of the ELVDD, thereby to prevent the occurrence of the crosstalk between lines and improve the display effect of the display substrate.

In a possible embodiment of the present disclosure, the grayscale value of the green grayscale data may be $2^n/2-1$ or $2^n/2$. When the green grayscale data is 8-bit data, the grayscale value of the green grayscale data may be 127 or 128. In this regard, when a white image having a grayscale value of 255 is displayed by the display substrate, a difference between the grayscale value of the grayscale data inputted to the pixels in the boundary row and the grayscale value of the grayscale data inputted to the pixels in the next row may be not greater than 128. At this time, it is able to reduce the voltage difference between the data signal on the data line connected to the pixels in the boundary row and the data signal on the data line connected to the pixels in the next row, and prevent the occurrence of a jump of the ELVDD, thereby to prevent the occurrence of the crosstalk between lines and improve the display effect of the display substrate. When a black image having a grayscale value of 0 is displayed by the display substrate, the difference between the grayscale value of the grayscale data inputted to the pixels in the boundary row and the grayscale value of the grayscale data inputted to the pixels in the next row may be not greater than 128 too. At this time, it is able to reduce the voltage difference between the data signal on the data line connected to the pixels in the boundary row and the data signal on the data line connected to the pixels in the next row, and prevent the occurrence of a jump of the ELVDD, thereby to prevent the occurrence of the crosstalk between lines and improve the display effect of the display substrate. In a word, regardless of the color of the image displayed by the display substrate, the difference between the grayscale value of the grayscale data inputted to the pixels in the boundary row and the grayscale value of the grayscale data inputted to the pixels in the next row may be not greater than 128. As a result, it is able to reduce the voltage difference between the data signal on the data line connected to the pixels in the boundary row and the data signal on the data line connected to the pixels in the next row, and prevent the occurrence of a jump of the ELVDD, thereby to prevent the occurrence of the crosstalk between lines and improve the display effect of the display substrate.

Further, the display substrate may be an OLED display substrate.

When an image is displayed by the display substrate, the black grayscale data may be inputted to the pixels at the second region, so as to subject the boundary of the notch region S1 to smoothing treatment and reduce the occurrence of sawteeth. The green grayscale data may be inputted to the pixels in the boundary row at the second side (the bottom side) of the first region A adjacent to the active display region S1. The green grayscale data may be 8-bit data and has a grayscale value of 127. Usually, the AMOLED display substrate is provided with an SPR structure, and when one row of pixels are used for display, red subpixels and blue subpixels of pixels in the previous row may also participate in the display. When the white grayscale data is inputted to the pixels in the boundary row at the first region adjacent to the active display region, the red subpixels and the blue subpixels in the boundary row may also participate in the display. When the pixels in a row (at the active display region) next to the boundary row are used for display, the red subpixels and the blue subpixels in the boundary row may participate in the display, so a color abnormality may occur for the pixels in the row next to the boundary row. When the green grayscale data is inputted to the pixels in the boundary row, the red subpixels and the blue subpixels in the boundary row may not participate in the display, so the display using the pixels in the row next to the boundary row may not be adversely affected. The white grayscale data may be inputted to the pixels at the first region A other than the pixels in the boundary row, and the white grayscale data may be 8-bit data and have a grayscale value of 127. At this time, regardless of the color of the image displayed by the display substrate, the difference between the grayscale value of the grayscale data at a region of the first region A adjacent to the active display region S2 and the grayscale value of the grayscale data at the active display region may be not greater than 128. As a result, it is able to reduce the voltage difference between the data signal on the data line connected to the pixels at a region of the active display region adjacent to the notch region and the data signal on the data line connected to the pixels at the notch region, and prevent the occurrence of a jump of the ELVDD, thereby to prevent the occurrence of the crosstalk between lines and improve the display effect of the display substrate.

The present disclosure further provides in some embodiments a driving circuit for a display substrate. As shown in FIGS. 1 and 3, the display substrate 1 includes an active display region S1 and a notch region S2 embedded in the active display region. The notch region S1 includes a first region A and a second region other than the first region, i.e., the second region includes a third region B and a fourth region C. A first side (a left side) of the first region A is not adjacent to the active display region S1, and a second side (a bottom side) of the first region A is adjacent to the active display region S1. Gate lines and data lines at the active display region extend to the notch region S2, and a pixel array is arranged at the active display region S1 and the notch region S2. The driving circuit is configured to, when an image is displayed by the display substrate, input grayscale data having a grayscale value smaller than $2^n-1$ and greater than 0 to pixels at at least a part of the first region, and the grayscale data is n-bit data.

According to the embodiments of the present disclosure, when the image is displayed by the display substrate, the grayscale data having a grayscale value smaller than $2^n-1$ and greater than 0 may be inputted to the pixels at pixels at a region of the notch region adjacent to the active display region. Hence, when the image is displayed by the display substrate, the inputted grayscale value may be adjusted so as to provide a relatively small difference between the grayscale value of the grayscale data inputted to the pixels at the region of the notch region adjacent to the active display region and the grayscale value of the grayscale data inputted to the pixels at the active display region. As a result, it is able to reduce a voltage difference between a data signal on a data line connected to the pixels at a region of the active display region adjacent to the notch region and a data signal on a data line connected to the pixels at the notch region, and prevent the occurrence of a jump of an ELVDD, thereby to prevent the occurrence of the crosstalk between lines and improve a display effect of the display substrate.

In a possible embodiment of the present disclosure, the second side (the bottom side) of the first region A may be adjacent to a first side (an top side of a middle portion) of the active display region S1, and a first boundary between the second side (the bottom side) of the first region A and the first side (the top side of the middle portion) of the active display region S1 may be a straight line extending in a row direction of the pixel array. The driving circuit is further configured to input white grayscale data having a grayscale value smaller than $2^n-1$ and greater than 0 to the pixels at at least a part of the first region, and input black grayscale data to pixels at the second region.

In the embodiments of the present disclosure, the white grayscale data may be inputted to the pixels at the first region of the notch region adjacent to the active display region, so as to provide a relatively small difference between the grayscale value of the grayscale data at the first region and the grayscale value of the grayscale data at the active display region. As a result, it is able to reduce a voltage difference between a data signal on a data line connected to the pixels at a region of the active display region adjacent to the notch region and a data signal on a data line connected to the pixels at the first region, and prevent the occurrence of a jump of the ELVDD, thereby to prevent the occurrence of the crosstalk between lines and improve the display effect of the display substrate. In addition, the black grayscale data may be inputted to the pixels at the second region, so as to subject a boundary of the notch region to smoothing treatment and reduce the occurrence of sawteeth in the displayed image.

The driving circuit is further configured to input green grayscale data having a grayscale value smaller than $2^n-1$ and greater than 0 to pixels at a boundary region of the first region adjacent to the first boundary, and input the white grayscale data to pixels at the first region other than the boundary region. The pixels at the boundary region may be a row of pixels nearest to the first boundary among all rows of the pixels in the pixel array, i.e., pixels in a boundary row.

Usually, an AMOLED display substrate is provided with an SPR structure, and when one row of pixels are used for display, red subpixels and blue subpixels of pixels in a previous row may also participate in the display. When the white grayscale data is inputted to the pixels in the boundary row at the first region adjacent to the active display region, the red subpixels and the blue subpixels in the boundary row may also participate in the display. When the pixels in a row (at the active display region) next to the boundary row are used for display, the red subpixels and the blue subpixels in the boundary row may also participate in the display, so a color abnormality may occur for the pixels in the row next to the boundary row. When the green grayscale data is inputted to the pixels in the boundary row, the red subpixels and the blue subpixels in the boundary row may not participate in the display, so the display using the pixels in the row next to the boundary row may not be adversely affected. In addition, when the green grayscale data having the grayscale value smaller than $2^n-1$ and greater than 0 may be inputted to the pixels in the boundary row, and when an image is displayed by the display panel, the inputted grayscale value may be adjusted, so as to provide a relatively small difference between the grayscale value of the grayscale data inputted to the pixels in the boundary row and the grayscale value of the grayscale data inputted to the pixels in the next row. As a result, it is able to reduce the voltage difference between the data signal on the data line connected to the pixels in the boundary row and the data signal on the data line connected to the pixels in the next row, and prevent the occurrence of a jump of the ELVDD, thereby to prevent the occurrence of the crosstalk between lines and improve the display effect of the display substrate.

Other two sides (i.e., the first side (the left side) and a third side (a right side)) of the first region A crossing the second side (the bottom side) of the first region A may extend in a column direction of the pixel array. To be specific, as shown in FIG. 1, the first region A may be a rectangular region arranged between the third region B and the fourth region C. The first side (the left side) of the first region A may be adjacent to a first side (a right side) of the third region B, a second side (a left side) of the third region B may be adjacent to the active display region S1, a third side (a right side) of the third region A may be adjacent to a first side (a left side) of the fourth region C, a second side (a right side) of the fourth region C may be adjacent to the active display region S1, and the first side (the left side) and the third side (the right side) of the first region A may be arranged opposite to each other and extend in a column direction of the pixel array. It should be appreciated that, the other two sides (i.e., the first side (the left side) and the third side (the right side)) of the first region A crossing the second side (the bottom side) of the first region A may not be limited to extending in the column direction, and they may alternatively extend along another straight line or a curve.

In a possible embodiment of the present disclosure, the grayscale value of the white grayscale data may be $2^n/2-1$ or $2^n/2$. When the white grayscale data is 8-bit data, the grayscale value of the white grayscale data may be 127 or 128. In this regard, when a white image having a grayscale value of 255 is displayed by the display substrate, a difference between the grayscale value of the grayscale data at a region of the first region adjacent to the active display region and the grayscale value of the grayscale data at the active display region may be not greater than 128. At this time, it is able to reduce the voltage difference between the data signal on the data line connected to the pixels at a region of the active display region adjacent to the first region and the data signal on the data line connected to the pixels at the first region, and prevent the occurrence of a jump of the ELVDD, thereby to prevent the occurrence of the crosstalk between lines and improve the display effect of the display substrate. When a black image having a grayscale value of 0 is displayed by the display substrate, a difference between the grayscale value of the grayscale data at a region of the first region adjacent to the active display region and the grayscale value of the grayscale data at the active display region may be not greater than 128 too. At this time, it is able to reduce the voltage difference between the data signal on the data line connected to the pixels at a region of the active display region adjacent to the first region and the data signal on the data line connected to the pixels at the first region, and prevent the occurrence of a jump of the ELVDD, thereby to prevent the occurrence of the crosstalk between lines and improve the display effect of the display substrate. In a word, regardless of the color of the image displayed by the display substrate, the difference between the grayscale value of the grayscale data at a region of the first region adjacent to the active display region and the grayscale value of the grayscale data at the active display region may be not greater than 128. As a result, it is able to reduce the voltage difference between the data signal on the data line connected to the pixels at a region of the active display region adjacent to the notch region and the data signal on the data line connected to the pixels at the notch region, and prevent the occurrence of a jump of the ELVDD, thereby to prevent the occurrence of the crosstalk between lines and improve the display effect of the display substrate.

In a possible embodiment of the present disclosure, the grayscale value of the green grayscale data may be $2^n/2-1$ or $2^n/2$. When the green grayscale data is 8-bit data, the grayscale value of the green grayscale data may be 127 or 128. In this regard, when a white image having a grayscale value of 255 is displayed by the display substrate, a difference between the grayscale value of the grayscale data inputted to the pixels in the boundary row and the grayscale value of the grayscale data inputted to the pixels in the next row may be not greater than 128. At this time, it is able to reduce the voltage difference between the data signal on the data line connected to the pixels in the boundary row and the data signal on the data line connected to the pixels in the next row, and prevent the occurrence of a jump of the ELVDD, thereby to prevent the occurrence of the crosstalk between lines and improve the display effect of the display substrate. When a black image having a grayscale value of 0 is displayed by the display substrate, the difference between the grayscale value of the grayscale data inputted to the pixels in the boundary row and the grayscale value of the grayscale data inputted to the pixels in the next row may be not greater than 128 too. At this time, it is able to reduce the voltage difference between the data signal on the data line connected to the pixels in the boundary row and the data signal on the data line connected to the pixels in the next row, and prevent the occurrence of a jump of the ELVDD, thereby to prevent the occurrence of the crosstalk between lines and improve the display effect of the display substrate. In a word, regardless of the color of the image displayed by the display substrate, the difference between the grayscale value of the grayscale data inputted to the pixels in the boundary row and the grayscale value of the grayscale data inputted to the pixels in the next row may be not greater than 128. As a result, it is able to reduce the voltage difference between the data signal on the data line connected to the pixels in the boundary row and the data signal on the data line connected to the pixels in the next row, and prevent the occurrence of a jump of the ELVDD, thereby to prevent the occurrence of the crosstalk between lines and improve the display effect of the display substrate.

The present disclosure further provides in some embodiments a display device including the above-mentioned driving circuit for the display substrate. The display device may be any product or member having a display function, e.g., television, display, digital photo frame, mobile phone, or flat-panel computer. The display device may further include a flexible circuit board, a printed circuit board and a back plate.

Unless otherwise defined, any technical or scientific term used herein shall have the common meaning understood by a person skilled in the art. Such words as "first" and "second" used in the present disclosure are merely used to differentiate different components rather than to represent any order, number or importance. Such words as "include" or "including" intends to indicate that an element or object before the word contains an element or object or equivalents thereof listed after the word, without excluding any other element or object. Such words as "connect/connected to" or "couple/coupled to" may include electrical connection, direct or indirect, rather than to be limited to physical or mechanical connection. Such words as "on", "under", "left" and "right" are merely used to represent relative position relationship, and when an absolute position of the object is changed, the relative position relationship will be changed too.

It should be appreciated that, in the case that such an element as layer, film, region or substrate is arranged "on" or "under" another element, it may be directly arranged "on" or "under" the other element, or an intermediate element may be arranged therebetween.

The above embodiments are merely preferred embodiments of the present disclosure. It should be appreciated that, a person skilled in the art may make further modifications and improvements without departing from the principle of the present disclosure, and these modifications and improvements shall also fall within the scope of the present disclosure.

What is claimed is:

1. A driving method for a display substrate, wherein the display substrate comprises an active display region and a notch region embedded in the active display region, a pixel array is arranged at the active display region and the notch region, a gate line and a data line at the active display region extend to the notch region, the notch region comprises a first region and a second region other than the first region, a first side of the first region is not adjacent to the active display region, and a second side of the first region is adjacent to the active display region, wherein the driving method comprises:

when an image is displayed by the display substrate, inputting grayscale data having a grayscale value smaller than $2^n-1$ and greater than 0 to pixels at at least a part of the first region, wherein the grayscale data is n-bit data, and wherein the second side of the first region is adjacent to a first boundary of the active display region, and the second side of the first region and the first boundary of the active display region are each a straight line extending in a row direction of the pixel array, wherein the inputting the grayscale data having the grayscale value smaller than $2^n-1$ and greater than 0 to the pixels at at least the part of the first region comprises:

inputting white grayscale data to the pixels at at least the part of the first region, wherein the white grayscale data has a grayscale value that is smaller than $2^n-1$ and greater than 0; and inputting black grayscale data to pixels at the second region.

2. The driving method according to claim 1, wherein the inputting the white grayscale data to the pixels at at least the part of the first region comprises:

inputting green grayscale data to pixels at a boundary region of the first region, wherein the boundary region of the first region is adjacent to the first boundary, and the green grayscale data has a grayscale value that is smaller than $2^n-1$ and greater than 0; and inputting the white grayscale data to pixels at the first region other than the boundary region.

3. The driving method according to claim 2, wherein the pixels at the boundary region comprise a row of pixels in the pixel array, and the row of pixels is nearest to the first boundary among rows of pixels in the pixel array.

4. The driving method according to claim 2, wherein the grayscale value of the green grayscale data is $2^n/2-1$ or $2^n/2$.

5. The driving method according to claim 1, wherein the second region comprises a third region and a fourth region, the first region is a rectangular region arranged between the third region and the fourth region, the first side of the first region is adjacent to a first side of the third region, a second side of the third region is adjacent to the active display region, a third side of the first region is adjacent to a first side of the fourth region, a second side of the fourth region is adjacent to the active display region, and the first side and the third side of the first region are arranged opposite to each other and extend in a column direction of the pixel array.

6. The driving method according to claim 1, wherein the grayscale value of the white grayscale data is $2^n/2-1$ or $2^n/2$.

7. The driving method according to claim 1, wherein the display substrate is an Organic Light Emitting Diode (OLED) display substrate.

8. A driving circuit for a display substrate, wherein the display substrate comprises an active display region and a notch region embedded in the active display region, a pixel array is arranged at the active display region and the notch region, a gate line and a data line at the active display region extend to the notch region, the notch region comprises a first region and a second region other than the first region, a first side of the first region is not adjacent to the active display region, and a second side of the first region is adjacent to the active display region, wherein the driving circuit is configured to:

when an image is displayed by the display substrate, input grayscale data having a grayscale value smaller than $2^n-1$ and greater than 0 to pixels at at least a part of the first region, wherein the grayscale data is n-bit data, wherein the second side of the first region is adjacent to a first boundary of the active display region, and the second side of the first region and the first boundary of the active display region are each a straight line extending in a row direction of the pixel array, and wherein the driving circuit is further configured to: input white grayscale data to the pixels at at least the part of the first region, and input black grayscale data to pixels at the second region, wherein the white grayscale data has a grayscale value that is smaller than $2^n-1$ and greater than 0.

9. The driving circuit for the display substrate according to claim 8, wherein the driving circuit is further configured to: input green grayscale data to pixels at a boundary region of the first region, and input the white grayscale data to pixels at the first region other than the boundary region, wherein the boundary region of the first region is adjacent to the first boundary, and the green grayscale data has a grayscale value that is smaller than $2^n-1$ and greater than 0.

10. The driving circuit for the display substrate according to claim 9, wherein the pixels at the boundary region comprise a row of pixels in the pixel array, and the row of pixels is nearest to the first boundary among rows of pixels in the pixel array.

11. The driving circuit for the display substrate according to claim 9, wherein the grayscale value of the green grayscale data is $2^n/2-1$ or $2^n/2$.

12. The driving circuit for the display substrate according to claim 8, wherein the second region comprises a third region and a fourth region, the first region is a rectangular region arranged between the third region and the fourth region, the first side of the first region is adjacent to a first side of the third region, a second side of the third region is adjacent to the active display region, a third side of the first region is adjacent to a first side of the fourth region, a second side of the fourth region is adjacent to the active display region, and the first side and the third side of the first region are arranged opposite to each other and extend in a column direction of the pixel array.

13. The driving circuit for the display substrate according to claim 8, wherein the grayscale value of the white grayscale data is $2^n/2-1$ or $2^n/2$.

14. A display device, comprising the driving circuit for the display substrate according to claim 8.

15. The display device according to claim 14, wherein the second side of the first region is adjacent to a first boundary of the active display region, and the second side of the first region and the first boundary of the active display region are each a straight line extending in a row direction of the pixel array, wherein the driving circuit is further configured to: input white grayscale data to the pixels at at least the part of the first region, and input black grayscale data to pixels at the second region, wherein the white grayscale data has a grayscale value that is smaller than $2^n-1$ and greater than 0.

16. The display device according to claim 15, wherein the driving circuit is further configured to: input green grayscale data to pixels at a boundary region of the first region, and input the white grayscale data to pixels at the first region other than the boundary region, wherein the boundary region of the first region is adjacent to the first boundary, and the green grayscale data has a grayscale value that is smaller than $2^n-1$ and greater than 0.

17. The display device according to claim 16, wherein the pixels at the boundary region comprise a row of pixels in the pixel array, and the row of pixels is nearest to the first boundary among rows of pixels in the pixel array.

18. The display device according to claim 15, wherein the second region comprises a third region and a fourth region, the first region is a rectangular region arranged between the third region and the fourth region, the first side of the first region is adjacent to a first side of the third region, a second side of the third region is adjacent to the active display region, a third side of the first region is adjacent to a first side of the fourth region, a second side of the fourth region is adjacent to the active display region, and the first side and the third side of the first region are arranged opposite to each other and extend in a column direction of the pixel array.

* * * * *